US005329975A

United States Patent [19]

Heitel

[11] Patent Number: 5,329,975

[45] Date of Patent: Jul. 19, 1994

[54] APPARATUS FOR PRESSURIZING CONTAINERS AND CARBONATING LIQUIDS

[76] Inventor: Robert G. Heitel, 1320 La Mirada St., Laguna Beach, Calif. 92651

[21] Appl. No.: 125,105

[22] Filed: Sep. 22, 1993

[51] Int. Cl.[5] ..... B67C 3/00

[52] U.S. Cl. ..... 141/17; 141/98; 141/329; 99/323.1; 261/DIG. 7; 215/228; 222/5

[58] Field of Search ..... 141/17, 19, 3, 4, 67, 141/329, 389, 98, 38; 99/323.1, 323.2; 261/DIG. 7; 222/5, 152, 399; 215/228, 260, 262; 128/205.21, 203.21; 604/70, 71

[56] References Cited

U.S. PATENT DOCUMENTS

| | | | |
|---|---|---|---|
| 2,705,578 | 4/1955 | Burns | 141/19 |
| 4,838,324 | 6/1989 | Boyd | 215/260 |
| 4,867,209 | 9/1989 | Santoiemmo | 141/329 |
| 4,934,543 | 6/1990 | Schmidt | 222/5 |
| 4,969,493 | 11/1990 | Lee | 222/5 |

*Primary Examiner*—Henry J. Recla
*Assistant Examiner*—Steven O. Douglas
*Attorney, Agent, or Firm*—Knobbe, Martens, Olson & Bear

[57] ABSTRACT

A device for pressurizing beverages within containers, including a hand-held charging gun adapted to controllably admit pressurized gas such as $CO_2$ into the container up to a predetermined limit. The charging gun includes a pressure regulating head and a manual control button. The pressure regulating head is sized to fit over a receptor of a check valve cap which is configured to thread onto the neck of a common beverage bottle. Positioning the charging gun so that the receptor fits within the receptor cavity and depressing the manual control button commences the flow of $CO_2$ gas into the bottle. At a predetermined pressure limit, a pressure regulator renders the continued depression of the control button ineffective and stops the gas flow. The pressure regulating head includes a blow-back plug for preventing matter from the bottle from entering the piston cylinder. A check valve in the cap includes a piston which is sealingly held against a gasket at the upper end of the receptor. An alternative check valve cap receives a spray head for dispensing the contents of the bottle as an aerosol.

14 Claims, 9 Drawing Sheets

FIG. 7
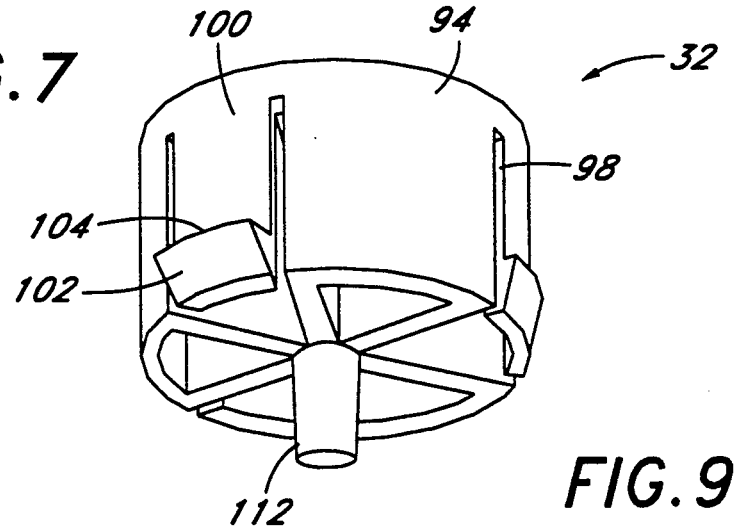
FIG. 8
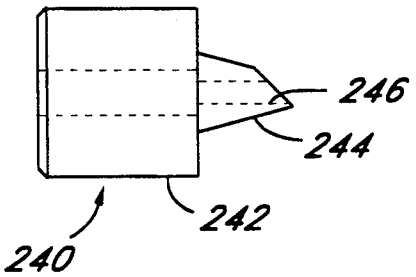
FIG. 9
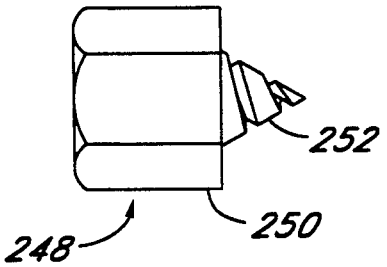
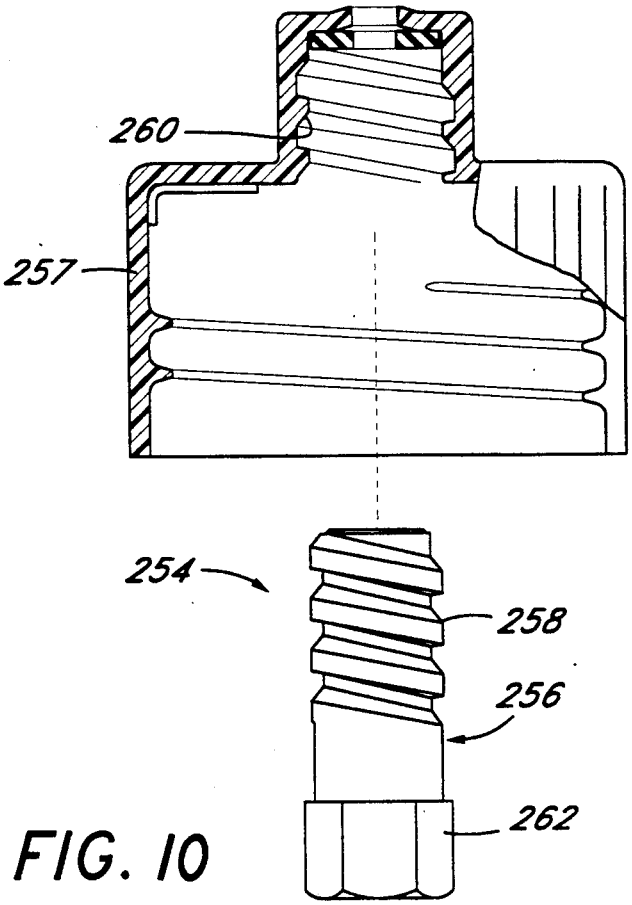
FIG. 10
FIG. 11
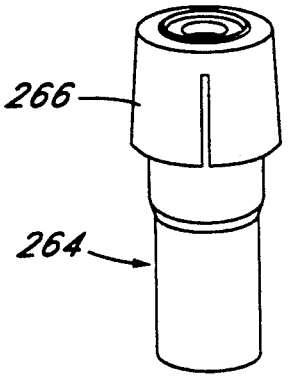

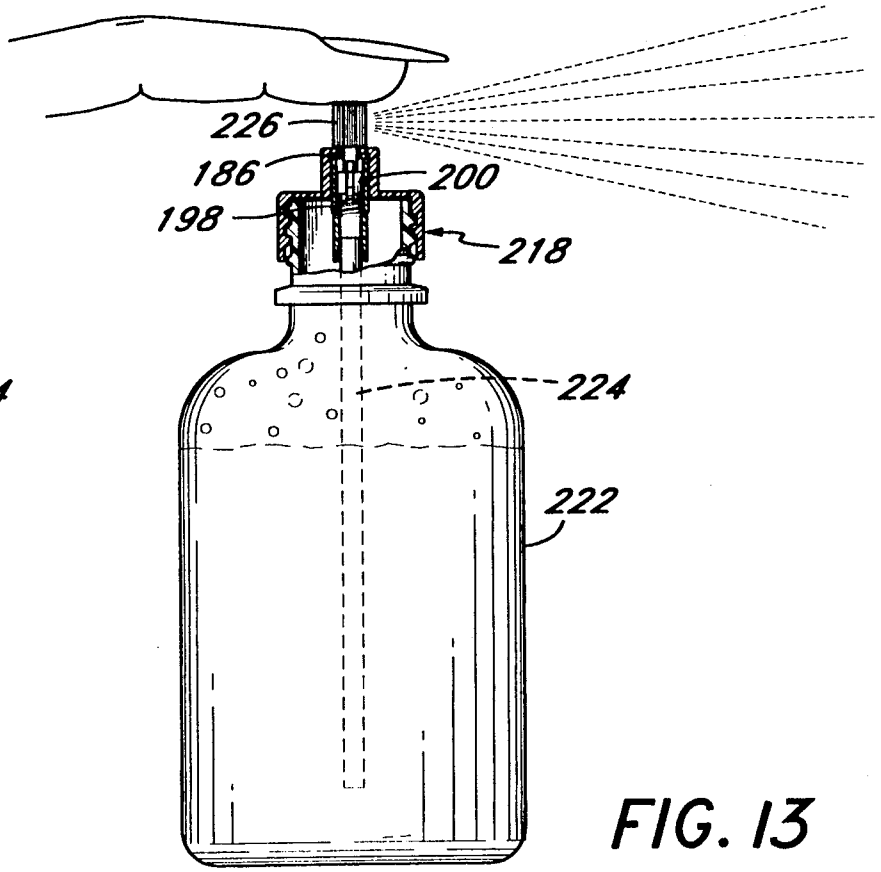
FIG. 13
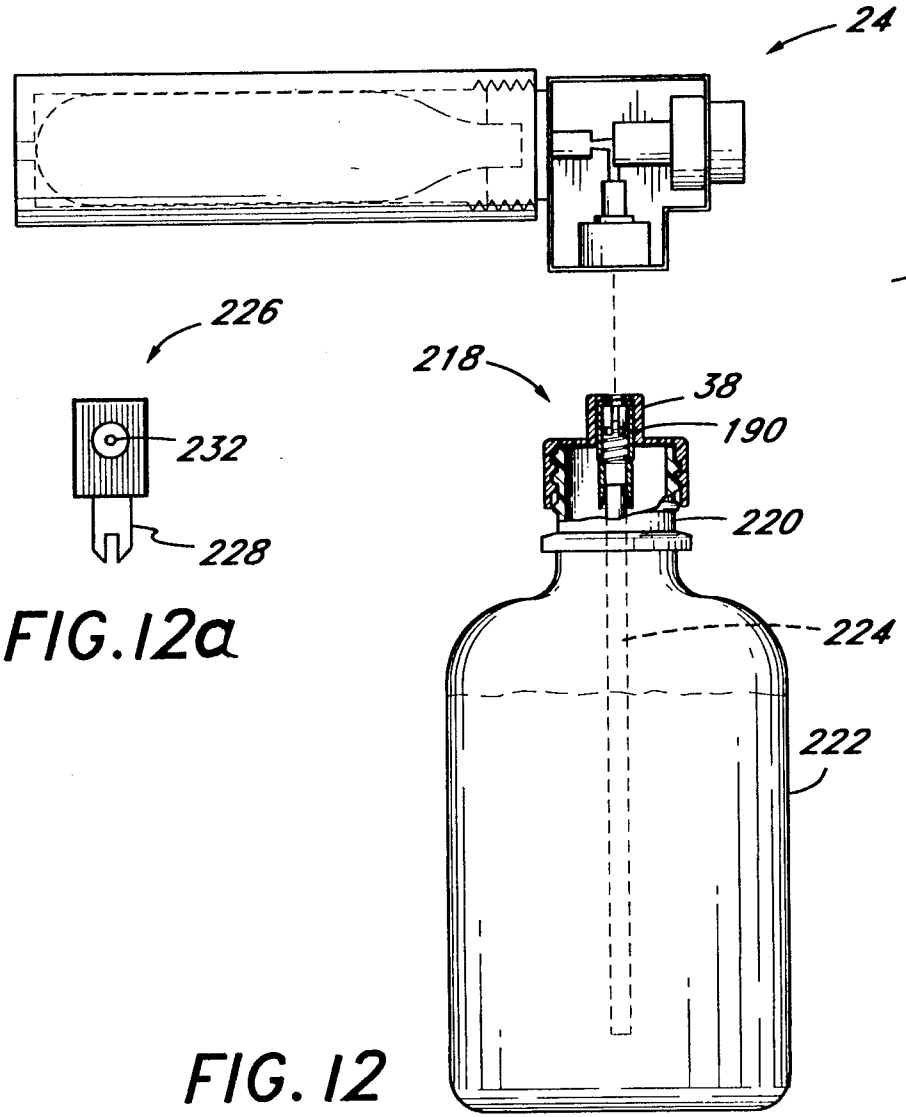
FIG. 12
FIG. 12a

APPARATUS FOR PRESSURIZING CONTAINERS AND CARBONATING LIQUIDS

FIELD OF THE INVENTION

This invention relates to the process of carbonating beverages and, more particularly, to a hand-held pressurizing apparatus.

BACKGROUND OF THE INVENTION

Devices for carbonating beverages in the home have been known for some time. They provide the consumer with an inexpensive means of carbonating normally flat beverages, such as water, juices, etc., to make homemade soda.

Commonly, home carbonators employ a pressurized carbon dioxide ($CO_2$) cartridge with a seal at one end that is punctured to release a gas into a container or bottle in order to carbonate the beverage within. The $CO_2$ within the cartridge is stored at pressures up to approximately 850 psi, and thus the bottle for storing the liquid to be carbonated must be a fairly heavy, thick-walled apparatus. Such systems were and are commonly used to make seltzer water. However, such heavy pressure bottles are expensive and relatively awkward to handle.

For example, U.S. Pat. No. 4,395,940 to Child, et al. discloses an appliance for making an aerated beverage utilizing a source of carbon dioxide and a pressure-regulating valve to limit the pressure within the bottle to a predetermined pressure limit, at which point the source $CO_2$ gas is vented with a whistling sound. This appliance has several drawbacks, not the least of which is the wasteful venting of the source gas upon reaching the predetermined pressure. Additionally, the device is housed in a relatively cumbersome package, which precludes easy portability.

In addition to a device which carbonates otherwise flat beverages, a need exists for a simple device to re-pressurize carbonated beverages after they have been opened by the consumer. Currently, carbonated beverages are sold in a variety of containers, ranging from 10-ounce to bulk-size one-, two- and three-liter thin-walled plastic bottles. For the consumer, the most cost-efficient size is the large economy bottle. However, unless the contents are consumed quickly, the quality of the carbonation is greatly reduced, as the $CO_2$ gas above the liquid escapes every time the bottle cap is opened. The $CO_2$ within the liquid then bubbles out due to the reduced $CO_2$ vapor pressure above the surface of the liquid, causing the remaining beverage to go flat. Commonly, a portion of the remaining flat contents is thrown away. It would be desirable to be able to recharge these economy-size soda bottles with $CO_2$ in order to maintain the carbonation of the beverage. A carbonation apparatus in this case would need to limit the pressure level within the plastic bottle to pressures on the order of 70 psi in order to ensure the plastic does not rupture.

In U.S. Pat. No. 4,867,209, issued to Santoiemmo, a portable carbonating device is shown having a pressurizer with an internal regulator for attaching to the top of a liquid-filled bottle to dispense $CO_2$ therein. The $CO_2$ is supplied from a disposable cartridge, which is pierced by a needle to deliver gas through the regulator valve and into the bottle. The regulator valve is mounted within a housing which has internal threads for mating with the external threads of the bottle and also a series of external threads on the upper end for mating with a cartridge-enclosing cap. In an alternative embodiment, the device utilizes a tire needle valve for retaining the $CO_2$ within the cartridge between uses. However, after introducing $CO_2$ to a bottle containing a liquid, it is intended that the entire device remain on the bottle for the pressure above the liquid to be maintained until the liquid has absorbed the $CO_2$. The device cannot be removed, for example, to pressurize a different bottle since that would release the pressure above the liquid, thus defeating the purpose of the device.

Aerosol cans are another separate but related product-line which are an extremely wasteful example of packaging and would benefit from some mode of recycling of the containers. The typical aerosol can is filled with a small quantity of hair spray, whipped cream, furniture polish, etc. and thrown away after emptying the contents within. It would be highly beneficial to the environment, as well as less expensive for the consumer, to provide an apparatus for the consumer to pressurize their own aerosol substances. One attempt at this is shown in U.S. Pat. No. 3,868,978 to Knopf. This patent shows a device for recharging canisters filled with whipped cream. An end plug having a valve assembly mounted within is threaded into the neck of a container holding the whipped cream. A connecting socket is then screwed onto a male thread portion of the valve assembly, the connecting socket being adapted to receive a neck of a gas cartridge which is screwed thereon with the use of an outer housing. The gas cartridge is pierced by a needle within the connecting socket, and the entire contents of the cartridge are allowed to bleed into the container. Unfortunately, this is a single-use $CO_2$ cartridge application with the inherent risk of over-pressurizing the container, causing a rupture.

Thus, a need exists for an improved hand-held carbonating device for safely pressurizing various types of liquid substances.

SUMMARY OF THE INVENTION

The present invention comprises a portable pressurizing system which can be used to pressurize a plurality of bottles with gas up to a predetermined pressure without wasting gas, including special bottle caps for retaining the pressure within the bottles. Specifically, the pressurizing system comprises a charging gun and a check valve cap sized to fit onto the threaded neck of a number of commercially manufactured bottles. To pressurize the bottle, the check valve caps are screwed onto the necks of the bottles and the gun is applied to the top of the caps. The gun includes a pressure regulating head and a gas cartridge housing. The gas cartridge housing is sized to receive small, inexpensive commercially available cartridges of pressurized gas, such as $CO_2$. A diaphragm in the gas cartridge is pierced to provide source gas to the gun.

The gun includes a coupling branch for mating with the top of the check valve cap, and also has a manual control button for selectively actuating and controlling the flow of gas through the gun and cap and into the bottle. Thus, the present gas pressurizing system may comprise a single gun and a plurality of check valve caps for pressurizing a number of bottles which are partially or fully filled with liquid. The cap coupling branch of the gun is simply pressed down on top of the cap and the manual control button actuated to inject gas into the bottle until a predetermined pressure is reached, the pressure being determined by an internal regulator in the pressure regulating head. A common use for the system of the present invention would be to inject $CO_2$-gas into 2-liter plastic bottles which are mass-marketed with soda or other carbonated beverage within. These 2-liter plastic bottles can withstand pressures of greater than 200 psi, but are designed to be pressurized to approximately 70 psi for safety reasons. Thus, the pressure regulating head of the gun may be set to halt the injection of $CO_2$ into the bottle when a pressure of 70 psi is reached. At the predetermined pressure, the pressure regulating head halts the flow of $CO_2$ and the user simply pulls the gun off the top of the check valve cap. The check valve within the cap retains the pressure within the bottle and a valve within the pressure regulating head similarly retains the remaining $CO_2$ within the pressurized cartridge. Thus, the gun may be transferred to a second bottle having a second check valve cap for further pressurizing.

According to one form of the present invention, a charging gun comprises a pressure regulating head and a gas cartridge housing threadingly received on a tubular branch of the head. The pressure regulating head is defined by a rigid body having three branches therefrom: a tubular branch having external threads, a cap coupler branch, and a control button branch. The gas cartridge housing is sized to receive a commercially supplied gas cartridge. The housing with the gas cartridge within is screwed onto the threaded tubular branch of the pressure regulating head to bring a diaphragm of the cartridge into contact with a sharp point of a piercing element concentrically mounted within a bore of the tubular branch. Gas fills a valve chamber, which is sealed at the inner end by a plug in contact with a valve seat. The pressure regulating head also includes a manual control button mounted within the control button branch for reciprocation along a central axis coincident with the axis of the valve plug. The manual control button applies a force to compress a spring which is in contact with a piston sized for sliding reciprocation within a cylinder. The piston includes an extending piston rod which is centrally disposed within a tapered passageway leading to the valve plug. Inward motion of the manual control button compresses the spring to force the piston rod to displace the valve plug and allow gas through the tapered passageway. The gas travels through the pressure regulating head body and subsequently through an actuator which may use an extending nipple. Thus, the charger gun is designed to be fit over the top of a check valve cap so that the nipple of the actuator extends through an aperture of the cap, whereupon the manual control button is depressed to commence the flow of gas and into a bottle to which the cap is attached.

BRIEF DESCRIPTION OF THE DRAWINGS

FIG. 7 is a perspective view of a preferred manual control button;

FIG. 8 is a side elevational view of an alternative configuration of a piercing element of the pressurizing system;

FIG. 9 is a side elevational view of a second alternative embodiment of a piercing element;

FIG. 10 is an exploded partial sectional view of an alternative check valve cap;

FIG. 11 is still another alternative version of a check valve housing;

FIG. 12 is a side elevational view of an alternative application of the pressurizing system;

FIG. 12*a* is a front elevational view of a spray head using in the system shown in FIG. 12; and FIG. 13 is a side elevational view of a spray bottle having a check valve cap and spray head of FIGS. 12 and 12*a* in use.

DESCRIPTION OF THE PREFERRED EMBODIMENTS

System

Figure 1:
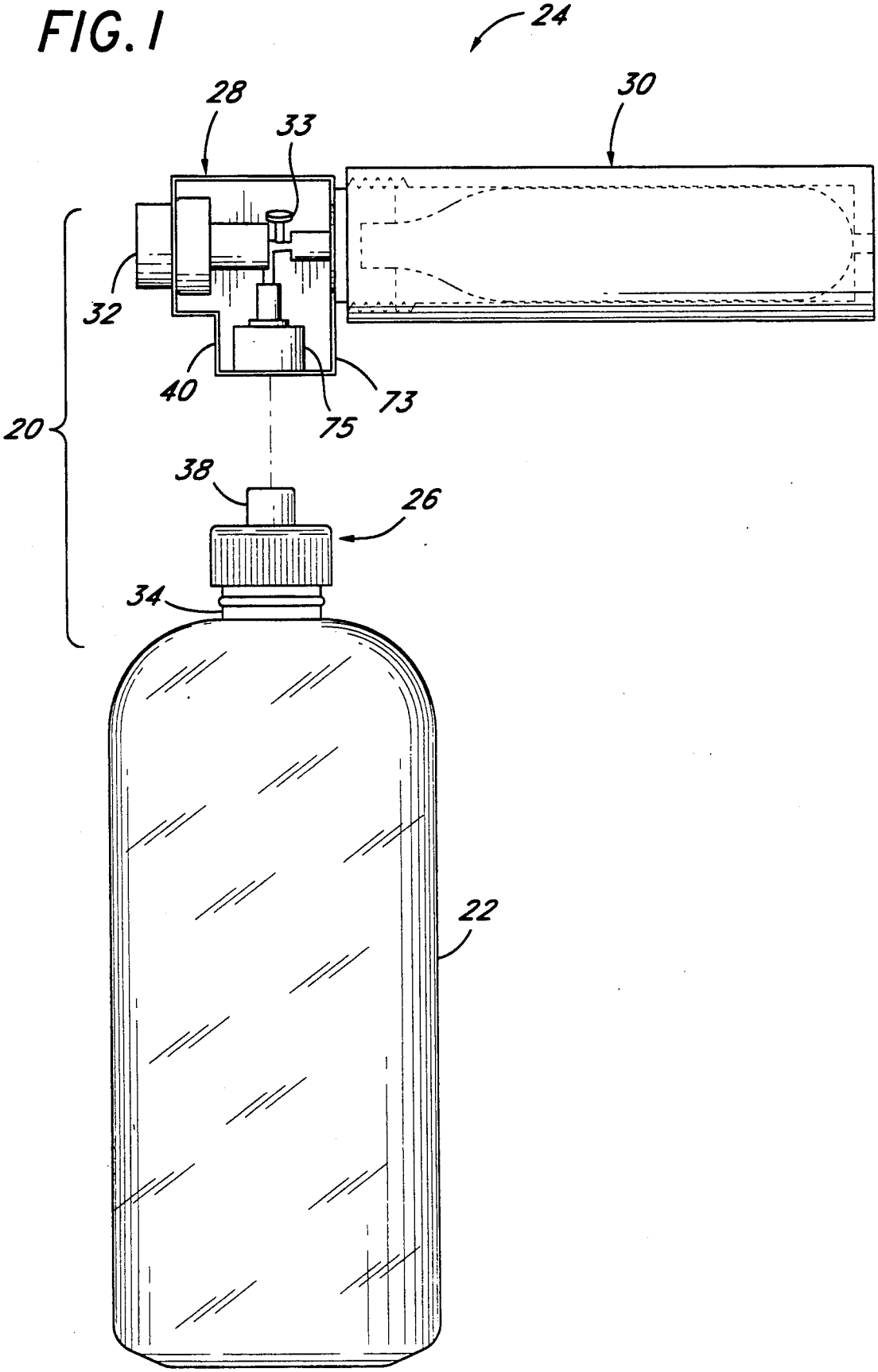
FIG. 1 is a side elevational view of a preferred pressurizing system of the present invention.

Referring to FIG. 1, the present invention provides a system 20 for pressurizing the contents of a bottle 22 with a gas such as carbon dioxide ($CO_2$). The system 20 comprises a hand-held pressurizing device, referred to herein as a charging gun 24, and a check valve cap 26. The charging gun 24 generally comprises two separable components, a pressure regulating head 28 and a gas cartridge housing 30, which are threadingly mated together. The pressure regulating head 28 includes a manual control button 32 which allows the user to selectively inject a limited amount of carbon dioxide into the bottle 22. For the purposes of this discussion, the bottle 22 is considered standing on its base with a neck 34 opening upwardly and the cap 26 attached thereon. The neck 34 of the bottle 22 includes exterior threads for receiving interior threads (not shown) in the check valve cap 26. The check valve cap 26 includes an upwardly extending male portion or receptor 38 shaped to mate with a female cap coupling branch 40 on the pressure regulating head 28. As depicted by the dashed line, the charging gun 24 is to be pressed onto the check valve cap 26, the coupling branch 40 releasably coupling with the receptor 38, whereupon the manual control button 32 is depressed to inject gas into the bottle 22. The system 20 includes an internal pressure limiting apparatus which prevents the over-pressurizing and possible rupture of the bottle 22.

The pressurizing system 20 may be used to provide $CO_2$ to a flat beverage such as water or juice in order to carbonate the beverage or, alternatively, to inject a limited amount of carbon dioxide into an opened bottle of carbonated beverage and to prevent a previously carbonated beverage from subsequently losing carbonation and going flat. In the former case, the $CO_2$ gas is held within the bottle 22 by the check valve cap 26 and eventually absorbs into the initially uncarbonated liquid over a period of time. In the latter application, the pressure above the liquid prevents $CO_2$ from releasing from the carbonated liquid due to the elevated vapor pressure.

A number of commercially available (plastic) bottles 22 may be employed. The check valve cap 26 may be provided in several sizes for different sized neck openings and threads. In one embodiment, a typical two-liter commercial plastic bottle having a neck opening of approximately 28 millimeters is preferred. Other bottles of smaller or larger sizes and made from glass or other material may be employed.

Charging Gun

Figure 3:
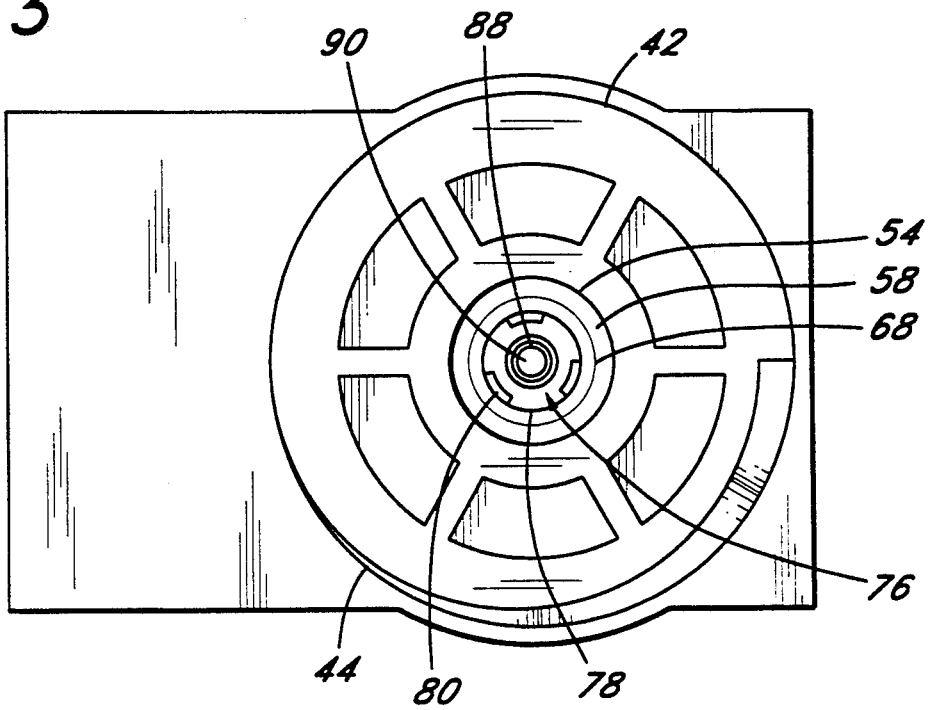
FIG. 3 is an end view of a pressure regulating head body taken along line 3—3 of FIG. 2.
Figure 4:
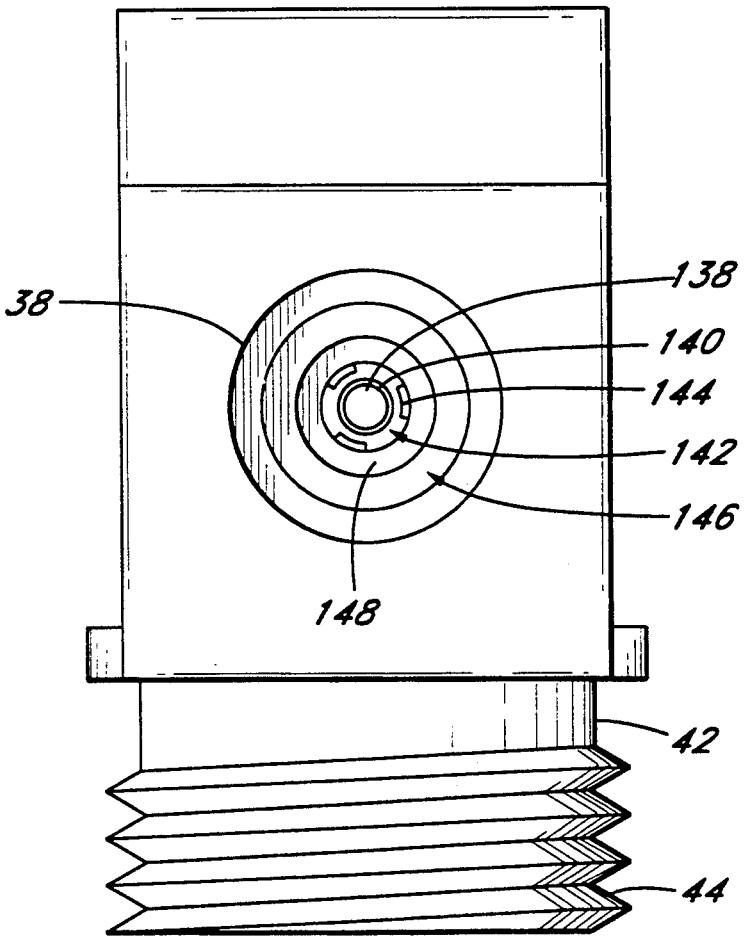
FIG. 4 is an end view of a pressure regulating head body taken along line 4—4 of FIG. 2.
Figure 5:
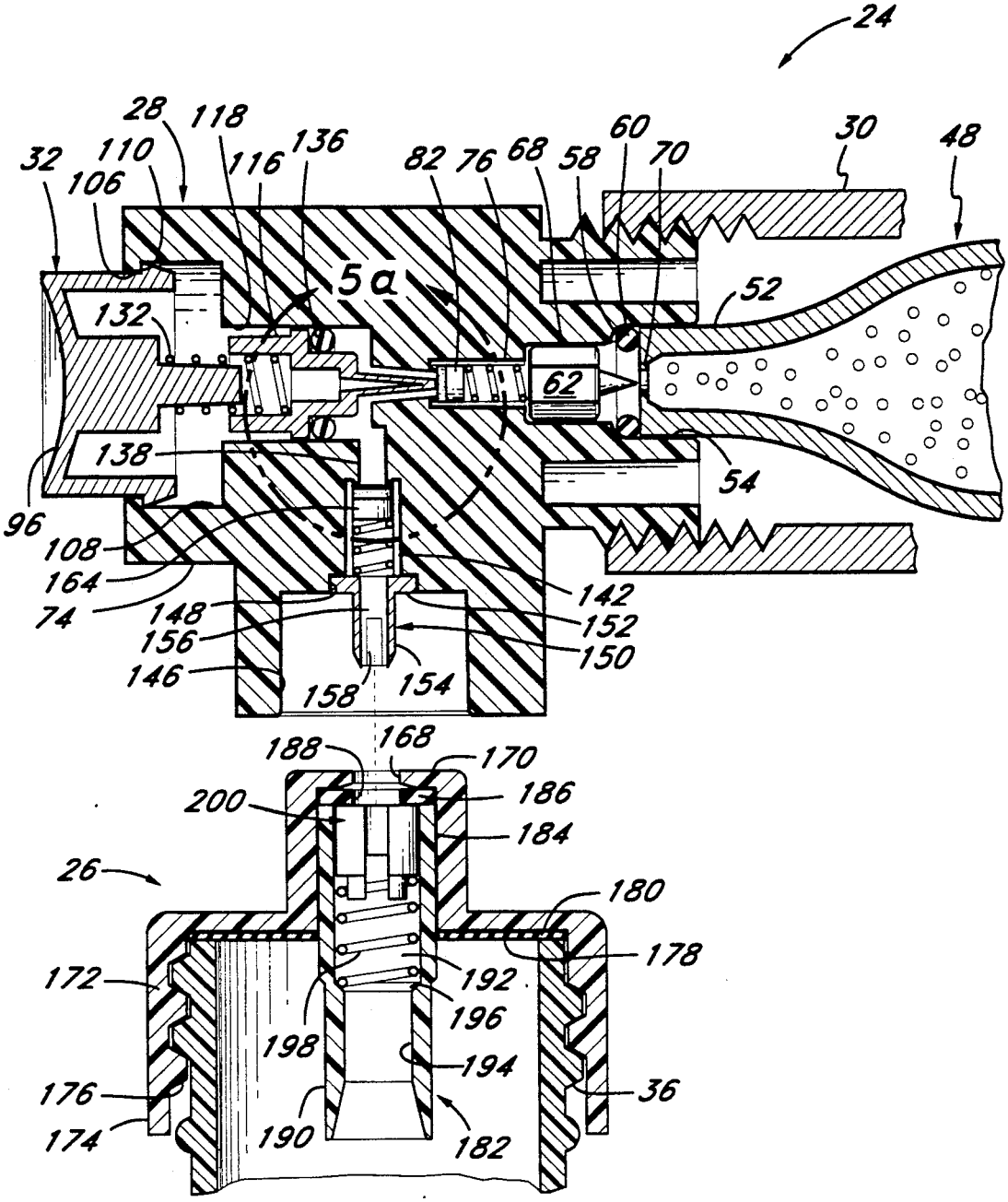
FIG. 5 is a cross-sectional view of the pressurizing system prior to actuation.

Now, referring to the exploded view of FIG. 2 and FIGS. 3–7, the details of the charging gun 24 are shown. The charging gun 24, as mentioned before, includes the pressure regulating head 28, which has a tubular branch 42 having male threads 44 for mating with female threads 46 on the interior of an open end of the cartridge housing 30. The cartridge housing 30 is hollow, cylindrical, and sized to receive a standard gas cartridge 48, such as a standard 12 gram cartridge containing $CO_2$, which is available commercially. The gas cartridge 48 generally comprises a bulbous main body portion 50 and a narrowed neck portion 52. As is shown in FIG. 5, the neck portion 52 is sized to slide into a neck receiving channel 54 having an end chamfer and terminating in a shoulder 58 in which a gasket or O-ring 60 is positioned. The cartridge housing 30 is threaded onto the tubular branch 42 to force the forward end of the neck portion 52 of the gas cartridge 48 into sealing contact with the O-ring 60. A piercing element 62, including a hex-shaped body 64 and a point 66, is fitted within a cylindrical inlet port or bore 68 of the tubular branch 42. The point 66 extends slightly into the neck receiving channel 54 for piercing a diaphragm 70 at the terminal end of the neck portion 52 of the gas cartridge.

Figure 6:
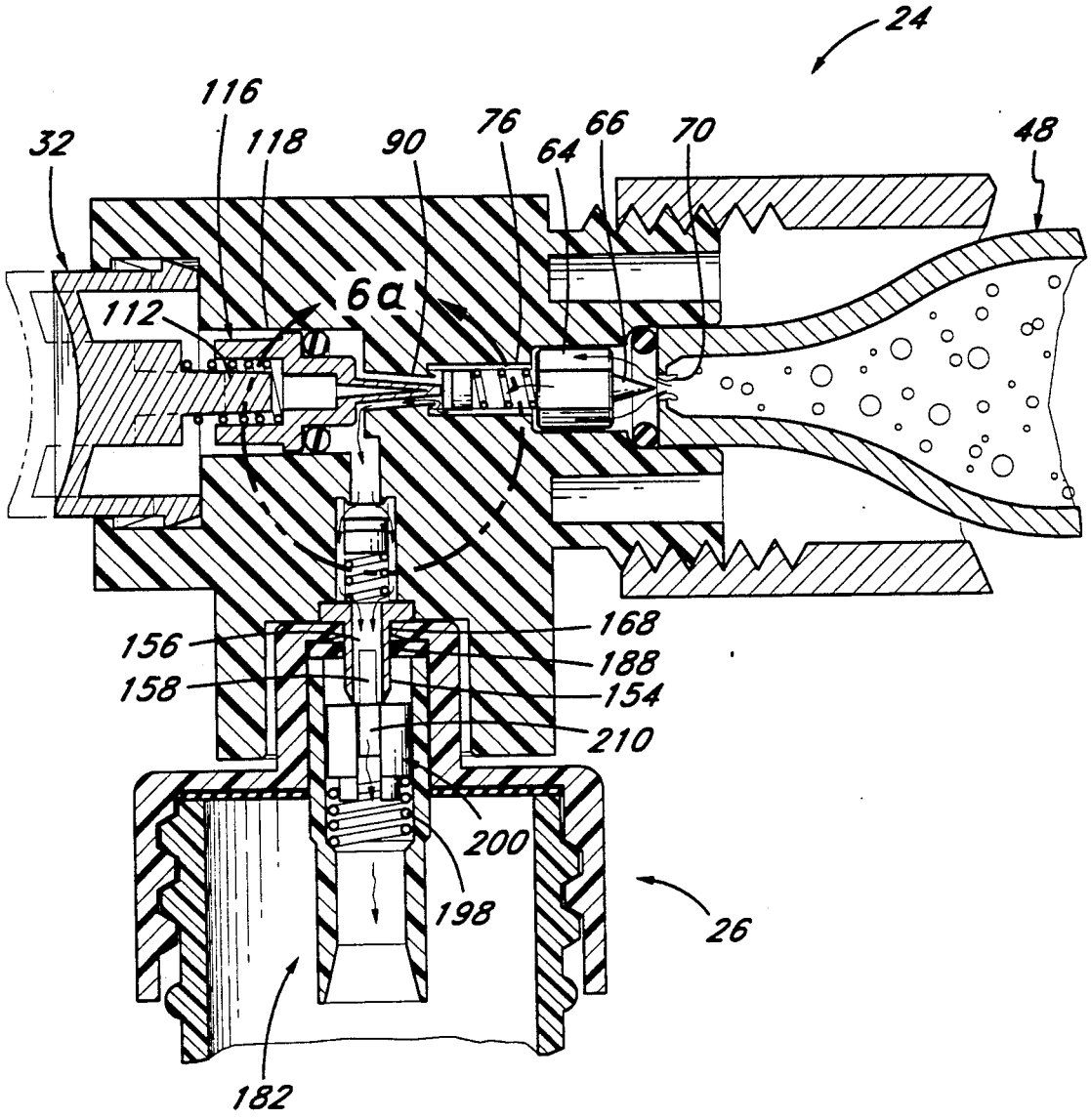
FIG. 6 is a cross-sectional view of the pressurizing system in the gas injection mode.

After the diaphragm 70 of the gas cartridge 48 is pierced, the diaphragm, the housing 30 is threadingly withdrawn a slight distance, to the position of FIG. 6, to allow gas to escape around the solid point 66. The gas passes between the piercing element 62 and bore 68 due to the spaces between the hexagonal sides of the body 64 and the cylindrical bore. As will be described in greater detail below, the piercing element 62 may take several forms; the function of each is to puncture the diaphragm 70 and release gas from the cartridge 48 into the pressure regulating head 28.

The pressure regulating head 28 comprises a rigid body having three outwardly extending branches meeting generally in the center, the branches being the aforementioned cap coupling branch 40, the tubular branch 42 and a control button branch 74. The cap coupling branch 40 fits over the receptor 38 of the check valve cap 26 such that the control button branch 74 and the tubular branch 42 and attached cartridge housing 30 are in line and generally perpendicular to a central axis of the cap coupling branch. As will be described below, the control button 32 is depressed to release gas from the cartridge 48, which passes through the pressure regulating head 28, into the cap coupling branch 40, and through the check valve cap 26 into the bottle 22.

While there are a number of possible manufacturing techniques for constructing the pressure regulating head 28, including machining, it is preferred that the head be molded, such as in an injection mold, without a substantially solid cross-section. Specifically, as seen in FIG. 1, the head 28 includes a peripheral support wall or frame 73 and interior walls 75 defining the internal passages and chambers therewithin. The absence of a solid volume reduces the mold process time as each part is cooled faster and ejected from the mold to clear the way for the next part.

Upstream Valve

As seen in FIGS. 3 and 5, a valve chamber 76 extends further inwardly into the pressure regulating head 28 from the bore 68. The valve chamber 76 has a cylindrical outer diameter 78 and a number of longitudinal plug rails 80 at circumferential intervals around the valve chamber. Preferably, at least three such rails are provided. A disk-shaped valve plug 82 is sized to slide within a cylindrical volume defined by the inner surfaces of the rails 80. The valve plug 82 includes a rigid portion 84 and an elastomeric portion 86. Other configurations are possible for the plug 82, such as a homogeneous hardened elastomer disk or even a simple ball valve arrangement.

The terminal end of the valve chamber 76 includes an upstream valve seat 88 leading to a tapered passageway 90. The elastomeric portion 86 of the valve plug 82 is on the upstream valve seat side so that a resilient seal is formed when the valve plug 82 is pressed against the valve seat 88. As is readily seen, when the point 66 pierces the diaphragm 70 of the cartridge 48, and gas is allowed to escape into the bore 68 and valve chamber 76, the valve plug 82 is automatically forced against the upstream valve seat 88 to prevent gas from passing further into the pressure regulating head 28. Furthermore, a valve spring 92 positioned between the valve plug 82 and inner end of the piercing element 62 helps force the plug into contact with the upstream valve seat 88, so as to prevent the flow of gas.

Control Button/Piston

Now referring to the control button branch 74 of the pressure regulating head 28, the control button 32, as seen in perspective in FIG. 7, is generally defined by a cylindrical skirt 94 extending from the peripheral edge of a concave surface 96. The cylindrical skirt 94 is interrupted around its circumference by a plurality of pairs of longitudinal slits 98. Each pair of slits 98 defines a cantilevered finger 100 having an outwardly projected latch defined by a tapered face 102 and a locking tooth 104. The cylindrical skirt 94 is sized slightly smaller than an aperture 106 formed at the opening of a button stroke chamber 108. To install the button in the chamber 108, the button 32 is pressed in through the aperture so that the tapered faces 102 contact the aperture to cam the fingers 100 inwardly. Once installed, the control button 32 reciprocates within the button stroke chamber 108, which has a shoulder 110 at the outward end. In this respect, after insertion of the control button 32, the fingers 100 spring outwardly, creating an interference between the locking teeth 104 and shoulder 110 and retaining the control button within the pressure regulating head 28.

The button 32 further comprises a central stepped plunger 112 concentrically disposed within the skirt 94 and sized to fit within a cavity 114 in a piston 116. The piston 116 is configured to slide axially within a cylinder 118 of the pressure regulating head 28. The cylinder 118 bottoms out at a cylinder face 120, which in turn has a central aperture leading to the aforementioned tapered passageway 90. By manually depressing the button 32, the position of the piston 116 within the cylinder 118 may be altered, as will be described more fully below.

Figures 2, 2A:
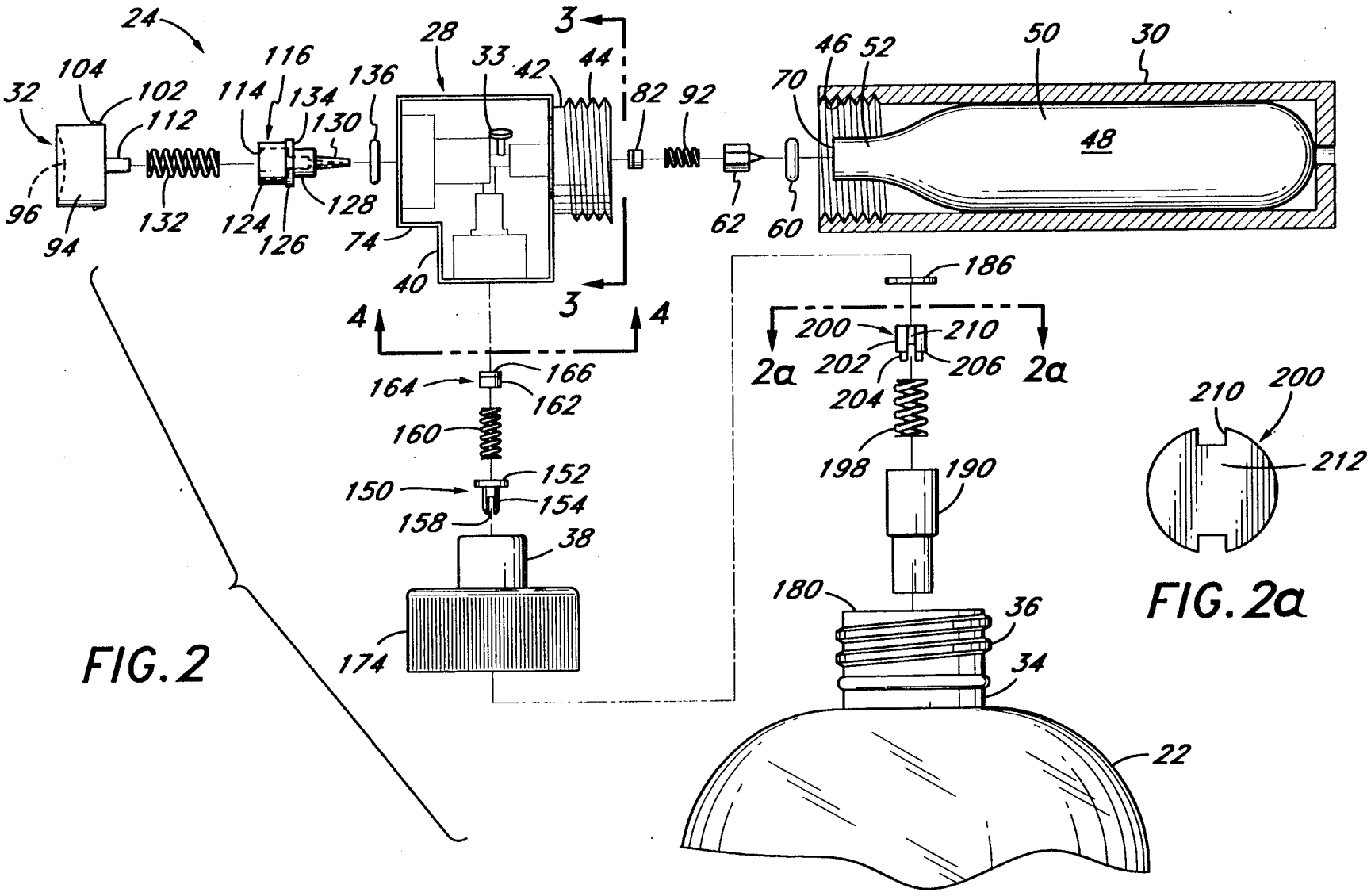
FIG. 2 is an exploded view of the pressurizing system of FIG. 1.
FIG. 2*a* is a top plan view of a check valve piston.

With reference to FIGS. 2 and 5, the piston 116 generally comprises a hollow member having various diameter cylindrical portions along its length. Specifically, beginning at the end with the cavity 114, the piston 116 comprises a spring guide portion 124, a ring portion 126, an O-ring section 128 and a tapered piston rod 130. As mentioned, the piston 116 is preferably hollow with two smaller sized cavities extending concentrically deeper within the piston from the cavity 114. It is preferred to utilize an injection molding process to form the piston 116, the hollow shape thus reducing the cooling time and associated process cycle time per part.

A regulator spring 132 is positioned within the cavity 114 defined by the spring guide portion 124 and sized to fit over the central plunger 112 of the manual control button 32. Thus, although the plunger 112 is sized to fit within the cavity 114, inward movement of the control button 32 is transmitted by the elastic compressive force of the spring 132 to the piston 116. The ring portion 126 is sized slightly smaller than the cylinder 118 and defines a shoulder 134 for an abutting O-ring 136 forming a sufficient seal with the inner wall of the cylinder and ring portion to prevent gas from escaping therebetween. In the alternative, the O-ring 136 may be dispensed with and the ring portion 126 may include an integral elastomeric skirt or have a close tolerance fit within the cylinder to provide the sliding seal therebetween. Furthermore, other arrangements are possible, including replacing the piston 116 and rod 130 with a diaphragm and separate valve actuator rod. In any event, the cylinder 118 is divided into an inner region, on the side of the bottom face 120, and an outer region by the seal between the O-ring 136 and cylinder wall.

In the preferred embodiment as illustrated in FIGS. 5, 5*a*, 6 and 6*a*, however, the tapered piston rod 130 extends within the tapered passageway 90, past the cylinder end face 120. In this respect, the terminal end of the tapered piston rod 130 may contact the elastomeric portion 86 of the valve plug 82 at the upstream valve seat 88. In the position whereby contact is just initiated between the piston rod 130 and valve plug 82, as in the position of FIGS. 5 and 5*a*, a predetermined stroke-travel distance remains between the shoulder O-ring section 128 and the cylinder face 120. Further inward travel of the piston 116 will displace the valve plug 82 from the upstream valve seat 88. Thus, the control button 32, coupled to the piston 116 and integral rod 130, and upstream valve seat 88 and plug 82 together comprise a gas actuating valve.

Downstream Valve

Figure 5A:
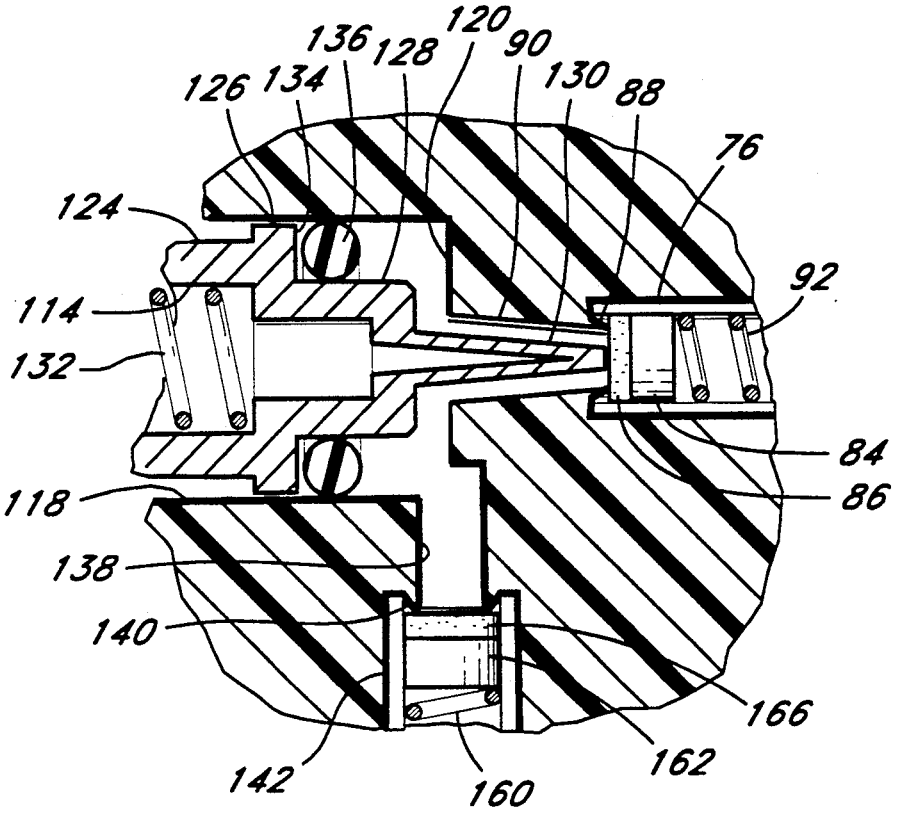
FIG. 5*a* is an enlarged view of a valve portion of a charging gun shown in FIG. 5 with no gas flowing.

As seen best in FIGS. 4, 5 and 5*a*, an outlet or transfer port 138 in the pressure regulating head 28 communicates with the portion of the cylinder on the O-ring 136 side of the piston ring portion 126 and extends in the direction of the cap coupling branch 40. The port 138 terminates in a downstream valve seat 140, which is at the inward end of a blow-back chamber 142. The blow-back chamber 142 includes a plurality of inwardly directed, circumferentially spaced ribs 144 defining a cylindrical volume therebetween. A relatively larger receptor cavity 146 at the outer end of the blow-back chamber 142 is sized to receive the receptor 38 of the check valve cap 26. A shallow actuator recess 148 provides a transition between the blow-back chamber 142 and the receptor cavity 146, and has a diameter intermediate the two.

An actuator 150 having a mounting flange 152 and a nipple 154 is mounted within the actuator recess 148. Preferably, the flange 152 of the actuator 150 is press-fit into the actuator recess 148 with the nipple 154 pointing outwardly into the receptor cavity 146 of the coupling branch 40. The actuator 150 has an internal gas flow passage defined by a central bore 156 and a plurality of slot-like passages 158 cut around the nipple 154 in communication with the bore. Between the flange 152 and the downstream valve seat 140, a blow-back spring 160 is positioned. The blow-back spring 160 contacts the flange 152 of the actuator 150 and also a rigid portion 162 of a disk-shaped blow-back plug 164 having an elastomeric portion 166. The blow-back plug 164 slides within the cylindrical volume defined by the ribs 144. The blow-back spring 160 thus helps force the blow-back plug 164 into sealing contact with the downstream valve seat 140, which prevents leakage into the transfer port 138 in situations where the pressures on either side of the plug 164 are approximately equivalent. Other configurations are possible for the plug 164, such as a homogeneous hardened elastomer disk or even a simple ball valve arrangement.

Check Valve Cap

Now, referring to FIGS. 5 and 6, which show cross sections of the check valve cap 26, the actuator nipple 154 is sized to fit within an aperture 168 in a top wall 170 of the receptor 38. The cap 26 generally comprises a thin-walled body 172 having a skirt 174, and the aforementioned receptor 38 extending concentrically upwardly from the skirt. The inner surface of the skirt 174 has a female thread 176 cut therein to receive the male thread 36 on the bottle neck 34. An elastomeric gasket 178 is placed against the inner top wall of the skirt 174 so that the terminal end 180 of the bottle neck 34 may form a seal therewith.

A check valve 182 is fastened into a cylindrical cavity 184 formed within the upwardly extending receptor 38. The check valve 182 is preferably ultrasonically welded within the cavity 184, but may also be threaded or otherwise attached rigidly thereto. The check valve 182 retains an annular gasket 186 against the top wall 170 of the receptor such that a central opening 188 in the gasket is coincident with the receptor aperture 168. The check valve 182 comprises a cylindrical housing 190 having an upper channel 192 and a lower channel 194 of smaller diameter, with a spring stop 196 therebetween. A check valve spring 198 and a check valve piston 200 are positioned to slide within the upper channel 192.

As seen best in FIGS. 2 and 2*a*, as well as FIGS. 5 and 6, the check valve piston 200 comprises an irregularly shaped element having an upper generally cylindrical portion 202 and depending bifurcated legs 204 that fit within the inner diameter of the check valve spring 198. The check valve spring 198 surrounds the legs 204 and is retained between a lower shoulder 206 of the piston 200 and the spring stop 196 located midway down the check valve housing 190. The legs 204 have a generally semicircular cross-sectional shape and are separated from each other across a gap which is contiguous with two gas flow slots 210 cut into the sides of the upper cylindrical portion 202. The slots 210 are preferably diametrically opposed across the cylindrical portion 202, but may be in other orientations. A flat upper face 212 of the check valve piston 202 forms a sealing surface against the annular gasket 186. In this respect, the central opening 188 in the annular gasket 186 is sized smaller than the distance between the slots 210. Thus, the check valve 182 is positioned within the receptor 38 such that the internal pressure in the bottle 22, in conjunction with the action of the check valve spring 198, forces the check valve piston 200 into sealing contact with the annular gasket 186 into a closed check valve position. This prevents the escape of gas from the bottle.

Operation

Figure 6A:
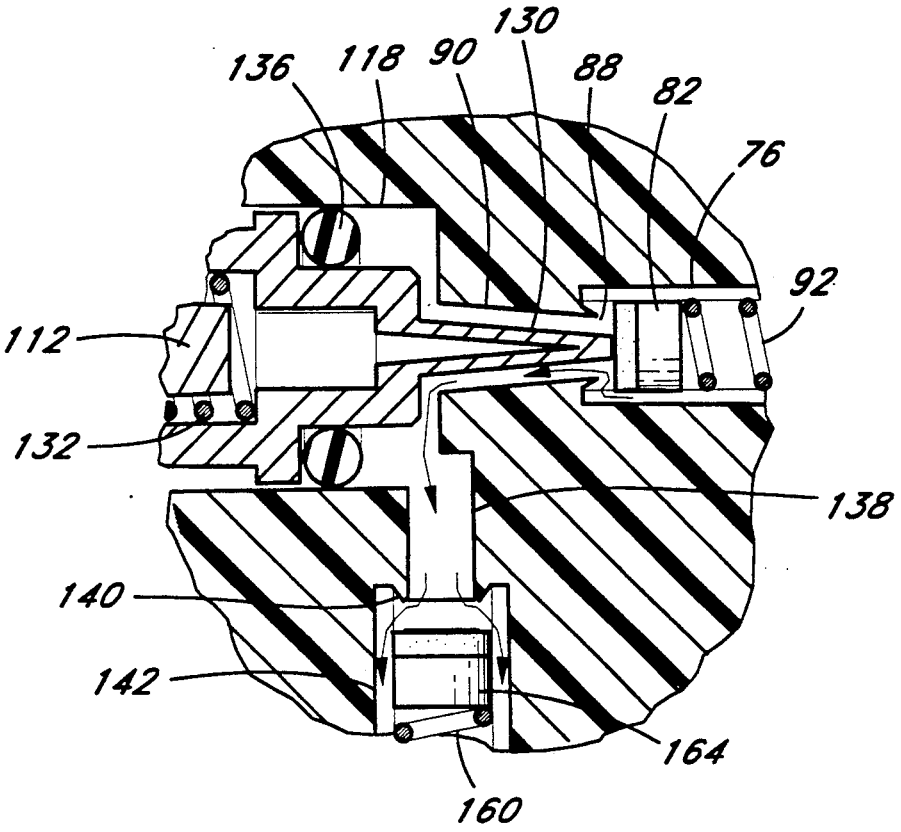
FIG. 6*a* is an enlarged view of a valve portion of the charging gun shown in FIG. 6 with gas flowing.

Now, with reference to FIGS. 6 and 6*a*, the actuation of the charging gun 24 will be described. Initially, the charging gun 24 is placed over the top of the bottle 22 so that the receptor 38 fits within the receptor cavity 146 of the pressure regulating head 28. The actuator nipple 154 projects through the central aperture 168 of the cap 38 and the opening 188 of the annular gasket 186 and displaces the check valve piston 200 away from the gasket against the force of the spring 198 and back pressure in the bottle. The check valve 182 is thus in an open position with the contents of the bottle 22 in communication with the blow-back chamber 142. The specific mating geometry of the receptor 38 and cap coupling branch 40 and actuator nipple 154 are given as exemplary only and other configurations are contemplated. In particular, the receptor 38 may include a male portion for insertion in an aperture of the cap coupling branch 40 in a mirror image of the illustrated embodiment.

The bottle 22 may be under pressure, and thus some gaseous or liquid matter may "blow back" through the actuator 150 and into the blow-back chamber 142 at the instant the nipple 154 displaces the piston 200. Advantageously, the provision of the spring-loaded blow-back plug 164 in sealing contact against the downstream valve seat 140 prevents this matter from traveling further and contaminating the transfer port 138 and cylinder 118 of the pressure regulating head 28. While this feature is preferred, the blow-back plug 164 may be optional.

When the actuator 150 is inserted through the cap aperture 168, and thereafter through the similar size opening 188 in the annular gasket 186 to contact and displace the check valve piston 200, the flat upper surface 212 (FIG. 2*a*) is displaced from the annular gasket, allowing gas to flow to and from the bottle 22. In this regard, gas typically flows into the bottle through the bore 156 and passages 158 of the actuator 150 past the aperture 168 and opening 188 and through the diametrically opposed gas flow slots 210 of the piston 200.

Again with reference to FIGS. 6 and 6*a*, the gas flow from the cartridge 48 into the bottle 22 will be described. The cartridge 48 within the housing 30 has previously been pierced by the point 66, and thus gas pressurizes the valve chamber 76 but is prevented from traveling past the upstream valve seat 88 by the sealing contact of the valve plug 82. The operator depresses the manual control button 32 to force the plunger 112 against the regulator spring 132, thus displacing the piston 116 within the cylinder 118. Movement of the piston 116 causes the tapered piston rod 130 to extend into the tapered passageway 90 until the terminal end of the rod displaces the valve plug 82 from the upstream valve seat 88.

The magnitude of force necessary to displace the plug 82 is equal to the area of the valve seat 88 times the pressure in the valve chamber 76, which is the same as the pressure in the cartridge 48. Thus, the spring 132 must be stiff enough to transmit this force "threshold" from the button 32 to the piston 116. Specifically, the outward and opposite forces imparted by the compressed spring 132 at the position shown in FIGS. 5 and 5*a* must be greater than this force threshold for the maximum pressure of a new gas cartridge 48. The spring 132 force may be adjusted by varying the spring preload, spring constant or distance the spring is compressed before the piston rod 130 contacts the plug 82. Alternatively, the upstream valve seat 88 size may be modified to optimize the force threshold.

Displacement of plug 82 allows pressurized gas to travel around the plug 82 and piston rod 130 and through the tapered passageway 90, into the cylinder 118, and into the transfer port 138. At this point, assuming the pressure of the gas in the cartridge 48 is greater than the pressure within the bottle 22 acting on the downstream side of the blow-back plug 164, the gas flows through the downstream valve seat 140, into the blow-back chamber 142, through actuator bore 156 and passages 158, through the gas flow slots 210 in the check valve piston 200, and ultimately into the bottle 22.

The injection of gas pressurizes the bottle 22 up to a predetermined limit, at which time the pressure regulating head 28 will automatically shut off the flow of gas. This is accomplished by the provision of the intermediate regulating spring 132 between the control button 32 and the piston 116. The inward force transmitted by the spring 132 to the piston 116 is resisted by the force applied in the opposite direction against the O-ring 136 side of the piston by gas pressure within the cylinder 118. This force thus is approximately equal to the cross-sectional area of the cylinder 118 times the pressure.

At some point, the pressure within the bottle 22 will reach a predetermined value, and the pressure in the cylinder 118 on the O-ring side of the piston 116 will be identical due to the open channel of communication via the actuator 150 and check valve 182 interaction. A pressure-generated force on the piston 116 greater than the regulating spring force will cause the piston to retract. Concurrently, the piston rod 130 will also retract, eventually allowing the valve plug 82 to again seal with the upstream valve seat 88. This shuts off the flow of gas, thus limiting the maximum pressure delivered to the bottle 22. The dimensions of the cylinder 118 and piston 116, and the preload and spring constant of the regulating spring 132 may be adjusted to limit the pressure delivered to the bottle 22 to a predetermined value. In a common usage, plastic two-liter bottles may be pressurized up to 70 psi.

In the preferred embodiment, a safety feature is installed in the charging gun 24 or check valve cap 26 to prevent overpressurizing of the bottle 22. Such a device may be a burst disk, shown schematically at 33 in FIGS. 1 and 2, having an inner surface in fluid communication with the tapered passageway 90 which ruptures and forms an exhaust port when subjected to a predetermined pressure. In the alternative, the safety device could be a check valve or other similar expedient.

One important advantage to the present system 20 is the capacity to either fully or only partially pressurize containers. The provision of the manual control button 32 allows the consumer to regulate the mass of compressed gas and therefore the pressure delivered, and the rate at which the gas flows, to any preferred value. The range of pressures is from atmospheric to the maximum limit set by the pressure regulating head 28. The button 32 is simply depressed and released prior to reaching the maximum pressure. Thus, the consumer may partially carbonate beverages, for example, based on individual tastes. It is feasible that a pressure indicator (not shown) may be included in the system 20 to display the partial pressure. The indicator may take the form of a common pressure gauge connected to a port leading from the cylinder 118, or, alternatively, a pressure indicating rod, for instance.

Alternative Piercing Elements

FIG. 8 shows an alternative embodiment of piercing element 240 for use in the present invention. In the originally described piercing element 62, the point 66 is a simple cone and the body 64 is a solid hexagonal volume. In contrast, the piercing element 240 includes a solid cylindrical body 242 and a sharpened point 244 having a hollow throughbore 246 extending the length of the piercing element. The alternative piercing element 240 thus eliminates the necessity to first threadingly advance and then retract the cartridge housing 30, as described supra. In this embodiment, the point 244 pierces the diaphragm 70, whereupon gas may flow directly through the bore 246 and into the valve chamber 76.

In a further alternative embodiment shown in FIG. 9, a piercing element 248 comprises a hexagonal cross-sectional body 250 and a roughened piercing point 252. The point 252 is shown as a modified corkscrew, but may be any other rough style of point common to metal diaphragm piercing devices. The roughened point 252 ruptures the diaphragm 70 in such a manner that gaps exist between the jagged metal of the diaphragm and the point for gas to escape. Thus, the cartridge housing 30 need only be advanced onto the tubular branch 42 for the piercing element 248 to work effectively.

Alternative Check Valve Cap

As shown in FIG. 10, an alternative check valve cap 254 is shown exploded having a threaded cylindrical check valve housing 256 and main body 257. The housing 256 includes similar internal check valve elements as the abovedescribed cylindrical housing 190. In place of the ultrasonically bonded connection between the prior housing 190 and check valve cap 26, the housing 256 includes threads 258 sized to mate with internal threads 260 in the body 257. A nut end 262 or other type of tightening means provides a positive torque grip for the housing 256 when threading into the check valve cap 254.

In a still further version, an alternative check valve housing 264 is shown in FIG. 11. Again, this housing 264 includes identical internal working elements as described for the housing 190. In order to attach the housing 264 within a check valve cap (not shown), the housing includes a plurality of outwardly extending cantilevered spring elements 266 which are configured to mate with an internal shoulder of the cap. In this respect, the cylindrical housing 264 need only be pressed into the receptor of the check valve cap, the spring elements being bent inward until they can spring outward into retaining contact with the shoulder.

Indeed, it is contemplated that the check valve 182 be of a more simplified construction than is illustrated in the preferred embodiment. For example, the valve may comprise a simple elastomeric ball sized to form a seal with a valve seat defined by the upper aperture 168. In this case, the ball is held in a sealing position by pressure within the bottle. Furthermore, it is possible that the actuator nipple be eliminated and simply coupling the charging gun 24 with the check valve cap 26 and applying pressurized gas to the receptor aperture 168 will displace the ball and allow the bottle to be pressurized.

Spray Application

In an alternative embodiment, the charging gun 24 of the present invention may be used to pressurize bottles filled with fluids which are suitable for spray applications. As shown in FIG. 12, a check valve cap 218 is screwed over the neck 220 of a bottle 222, with a depending straw 224 between the cap and bottle. The straw 224 is typical for spray applications and provides communication between the lower end of the control valve housing 190 and the lower confines of the bottle 222.

The receptor 38 is sized to receive a spray head 226 (FIG. 12*a*), which includes a similarly sized plunger 228 as the actuator nipple 154. After pressurizing the spray bottle 222 with the charging gun 24, as described above with respect to the process for pressurizing a beverage, the spray bottle is ready for use. The spray head 226 is then inserted into the upper aperture of the check valve cap 218 and manually depressed to cause the pressurized fluid within the spray bottle 222 to flow up the straw 224 and around the check valve piston 200 into an interior channel (not illustrated) of the spray head and out through a spray nozzle 232. Releasing manual pressure on the spray head 226 stops the flow of fluid due to the action of the pressure in the bottle 222 in conjunction with the check valve spring 198, pushing the piston 200 upwardly into contact with the annular gasket 186 once again.

Although this invention has been described in terms of certain preferred embodiments, other embodiments that are apparent to those of ordinary skill in the art are also within the range of this invention. Accordingly, the scope of the invention is intended to be defined only by reference to the following claims.

What is claimed is:

1. A system for pressurizing containers, said system comprising:

a charging gun which is sized to be held by hand, said gun sized to receive a standard cartridge containing compressed gas, said gun having:

a piercing element positioned to pierce a diaphragm on the cartridge to allow compressed gas to escape from the cartridge;

an inlet port into which gas from said cartridge flows;

an outlet port which is in fluid communication with said inlet port;

a manually controllable valve which controls the flow of gas out of the cartridge; a first check valve cap having an access port therethrough;

a coupling device for releasably coupling said outlet port with said access portion said check valve cap said cap being removably secured to an opening on said container so as to permit flow of compressed gas from said cartridge into said container; and said first check valve cap configured to be removably attached to an opening on a first container, said cap having:

a receptor portion defining said access prot which is adapted to mate with said coupling device;

and through which gas can flow into and out of said container while the cap is attached to the container; and a check valve in said access port normally held in a closed position so as to prevent gas flow out of said container and to retain pressure within the container;

wherein the receptor portion and coupling device of the gun are configured to be manually engaged in order to open the check valve and permit flow of gas from the cartridge into the container through the access port in the cap, and to be disengaged after the pressure within the container has reached a desired level, without releasing any pressure within the container.

2. The pressurizing system of claim 1, wherein said gun outlet port includes a blowback chamber having a valve which is forced into a closed position to prevent flow of fluids from the container into the gun.

3. The pressurizing system of claim 1, including a second check valve cap having a receptor portion substantially identical to the receptor portion of the first check valve cap and having a portion configured to sealingly mate with an opening of a second container different from the first container so that said charging gun can be used to pressurize either first or second containers.

4. The pressurizing system of claim 1, wherein said manually controllable valve includes a manually depressible control button and an upstream valve, the control button actuating the valve to open a gas flow path from the inlet port to the outlet port.

5. The pressurizing system of claim 4, including a pressure regulation spring and a piston having a rod positioned so that depressing the control button will compress the spring and cause the rod to displace a plug from a valve seat of the upstream valve and permit gas flow.

6. The pressurizing system of claim 5, wherein said piston reciprocates in a cylinder dividing the cylinder into an inner region and an outer region sealed from each other, and increasing pressure in the inner region acts to force the piston outward against the pressure regulation spring until the plug seals against the valve seat.

7. The pressurizing system of claim 1, wherein said coupling device comprises:

a cavity sized to receive the receptor portion of the check valve, and a nipple extending into said cavity, said nipple having a passage which establishes fluid communication with the outlet port; and wherein said check valve includes a piston having an upper face which is biased by a spring into sealing contact with an annular gasket, the annular gasket having an opening coincident with and adjacent to the aperture, the nipple of the charging gun passing through the aperture and gasket opening to displace the piston and open the check valve.

8. The system of claim 1 wherein said check valve cap further comprises:

a straw joined to the check valve and extending into the fluid stored within the container; and a spray head defining a fluid flow path, said spray head adapted to mate with the receptor so that manually depressing the spray head opens the check valve and permits flow of pressurized fluid through the straw and the spray head so that the fluid stored within the container can be dispersed in a spray.

9. A hand-held apparatus for pressurizing a container by charging the container with compressed gas from a standard compressed gas cartridge, said apparatus comprising:

a housing sized to receive a standard cartridge containing compressed gas;

a piercing element positioned to pierce a diaphragm on the cartridge to allow compressed gas to escape from the cartridge;

an inlet port into which gas from said cartridge flows;

an outlet port which is in fluid communication with said inlet port;

a manually controllable valve which controls the flow of gas out of the cartridge; and a coupling device for releasably and manually coupling said outlet port with a cap which is removably secured to an opening on said container and which contains a check valve which permits flow of pressurized gas into the container but normally prevents gas flow out of the container, said coupling device being adapted to actuate the check valve when the container is to be charged with said compressed gas.

10. The apparatus of claim 9 wherein the manually controllable valve permits a user to selectively vary the mass of gas expelled from the cartridge.

11. A gas pressurizing system, comprising:

a hand-held charging gun having a gas pressure regulating head joined to a gas cartridge housing, said housing sized to receive a compressed gas cartridge, the pressure regulating head comprising:

a piercing element for piercing a diaphragm of the gas cartridge;

a valve chamber in fluid communication with the contents of the gas cartridge once the diaphragm has been pierced;

an upstream valve at the opposite end of the valve chamber from the diaphragm, said upstream valve comprising a valve seat and a plug, the plug being sealingly held against the seat by pressure in the valve chamber;

a piston positioned to slide within a cylinder and dividing the cylinder into an inner region and an outer region sealed from each other, said piston having a rod extending into the inner region, the rod extending through a passageway into contact with the upstream valve plug;

a manual control button retained within a chamber adjacent the outer region of the cylinder;

a pressure regulating spring positioned between the outer end of the piston and the inner end of the control button to transmit displacement of said control button to said piston;

a transfer port in the inner region of the cylinder leading to an actuator having a nipple; and a first check valve cap having an aperture sized to receive said nipple and having internal threads shaped to sealingly mate with a neck of a first bottle containing a liquid, said first check valve cap having a check valve therewithin for retaining pressure within the bottle to which the cap is attached, wherein said first bottle may be pressurized by manually engaging the pressure regulating head to the check valve cap so that the nipple extends through the aperture to actuate said check valve, thereby opening a fluid communication path between the cylinder of the pressure regulating head and the contents of the bottle, and wherein depression of the control button causes the pressure regulating spring to compress and the piston rod to displace the valve plug from the upstream valve seat allowing pressurized gas from the cartridge to enter the cylinder and thereafter enter the bottle.

12. The pressurizing system of claim 11, including a blow-back chamber interposed between the transfer port and the actuator, said blow-back chamber having a downstream valve seat and plug, the plug being caused to seal against the downstream valve seat if the pressure within the blow-back chamber is equal to or greater than the pressure in the transfer port to prevent matter from the bottle from entering the transfer port.

13. The pressurizing system of claim 11, including a second check valve cap having internal threads shaped to sealingly mate with a different sized bottle than said first bottle so that said charging gun can be used to pressurize either first or second bottles.

14. The pressurizing system of claim 11, including a safety means for exhausting gas to the atmosphere when the pressure within the first bottle reaches a predetermined value.

* * * * *

UNITED STATES PATENT AND TRADEMARK OFFICE

CERTIFICATE OF CORRECTION

PATENT NO. : 5,329,975

DATED : July 19, 1994

INVENTOR(S) : Robert G. Heitel

It is certified that error appears in the above-indentified patent and that said Letters Patent is hereby corrected as shown below:

Column 12, line 60, change "portion said check valve cap" to -- port in said check valve cap, --;

Column 12, line 67, change "access prot which" to -- access port which --.

Signed and Sealed this

Twenty-sixth Day of November 1996

*Attest:*

Bruce Lehman

BRUCE LEHMAN

*Attesting Officer*

*Commissioner of Patents and Trademarks*